United States Patent [19]

Hayashi et al.

[11] 4,445,820

[45] May 1, 1984

[54] ELECTRICALLY POWERED PUMP

[75] Inventors: Kenji Hayashi; Kiyoshi Kato, both of Aichi, Japan

[73] Assignee: Aisan Kogyo Kabushiki Kaisha, Obu, Japan

[21] Appl. No.: 333,315

[22] Filed: Dec. 22, 1981

[30] Foreign Application Priority Data

Dec. 27, 1980 [JP] Japan ..... 55-185228
Apr. 8, 1981 [JP] Japan ..... 56-53641
May 30, 1981 [JP] Japan ..... 56-82618

[51] Int. Cl.[3] ..... F04B 35/04; F04D 5/00

[52] U.S. Cl. ..... 417/366; 417/423 R; 415/53 T; 415/198.2; 415/213 T

[58] Field of Search ..... 417/201, 206, 366, 410, 417/423 R; 418/182, 225; 415/53 T, 213 T, 198.2, 122 R

[56] References Cited

U.S. PATENT DOCUMENTS

| | | | |
|---|---|---|---|
| 2,936,714 | 5/1960 | Balje | 415/213 T |
| 3,796,526 | 3/1974 | Cawley | 418/97 |
| 3,969,044 | 7/1976 | Füssner et al. | 417/410 |
| 4,128,365 | 12/1978 | Kemmner et al. | 417/423 R |
| 4,209,284 | 6/1980 | Lochmann et al. | 417/366 |

FOREIGN PATENT DOCUMENTS

| | | | |
|---|---|---|---|
| 630802 | 7/1963 | Belgium | 417/423 R |

*Primary Examiner*—William L. Freeh

*Assistant Examiner*—Paul F. Neils

*Attorney, Agent, or Firm*—Dennison, Meserole, Pollack & Scheiner

[57] ABSTRACT

In the first embodiment of the present invention, the armature of the motor is rotatably fitted through the bearings provided at both ends of its rotary shaft. A rotor is rotatably mounted through a fixed shaft arranged differently from the rotary shaft to form a pump means. The rotary shaft and the rotor are connected by a connector means in such a manner that the radial displacement of both axes of the rotary shaft and the rotor can be absorbed by the connector.

In the second embodiment of the present invention, a pump housing of a pump means is adapted partly to serve as a part of the casing of the electrically powered pump. An inlet of the pumped liquid is formed in the pump housing and a union is integrally formed with the casing.

In the third embodiment of the present invention, the armature of the motor is rotatably fitted through the bearings provided at both ends of its rotary shaft. At least two stages of impellers are rotatably mounted to the fixed shaft arranged in axially alignment with the rotary shaft to form a pump means. The rotary shaft and the impellers are connected by a connector means in such a manner that the relative motion in a circumferential direction of the rotary shaft and the impellers is restricted.

2 Claims, 8 Drawing Figures

ELECTRICALLY POWERED PUMP

BACKGROUND OF THE INVENTION

This invention relates to an electrically powered pump for pumping liquid by driving a rotor or a plurality of impellers in a pump casing with a motor.

In a traditional electrically powered pump employable for a fuel pump of an automobile as shown in FIG. 1, a rotary shaft 7 of an armature 6 is rotatably fitted to two bearings 5 in a casing 4 which is provided with a field core (a permanent magnet) 2 of a motor 1 and a yoke 3. A pump means 12 is provided in the casing 4 in such a manner that two plates 8 and 9 and a spacer 10 are threadedly secured by a screw 11 across a pump casing. A rotor 14 and a roller 13 are received in the pump casing of the pump means 12. The rotor 14 is fitted to one end of the extension of the rotary shaft 7 from the bearing 5 by means of a woodruff key 15. The axis of the rotor 14 is eccentric to the axis of the pump casing and the roller 13 is adapted to rotate in sliding contact with the inner circumference of the pump casing through the rotation of the rotor 14 driven by the motor 1. In this case, the clearances between the plates 8 and 9 and the rotor 14 are generally required to be set to an extremely minimum, say, about 10μm in order to obtain a necessary pumping performance. In the arrangement where the rotor 14 is secured to the rotary shaft 7 of the armature 6, the axis of the rotary shaft 7 must be substantially perpendicular to the surface of the rotor 14 and the surfaces of the plates 8 and 9 must be substanially parallel to the surface of the rotor 14. Accordingly, every part of the pump means requires manufacture with a fairly high degree of accuracy.

However, it is to be noted that the manufacturing accuracy of the parts is limited and if the manufacturing accuracy is not assured, the preformance and the durability of the pump are reduced, thereby requiring considerable time and labor to the extent that the productivity of the pump is greatly decreased.

In another traditional electrically powered pump 101 employable for a fuel pump of an automobile as shown in FIG. 3, which is a vane type pump wherein a rotor 105 and a roller 106 are provided in a pump housing having plates 102 and 103 and a spacer 104. In this case, the clearances between the plates 102 and 103 and the rotor 105 are generally required to be set to an extremely minimum distance, say, about 10μm so as to obtain a necessary pumping performance. In the arrangement where the rotor 105 is secured to the rotary shaft 108 of the armature 107, the axis of the rotary shaft 108 must be substantially completely perpendicular to the surface of the rotor 105 and the clearance between the rotor 105 and the plate 103 must be set to about 10μm. Accordingly, every pump-related part requires finishing and assembly to an extremely high degree of accuracy, providing for any possible modification in the accuracy after assembling.

In the traditional pump as shown in FIG. 3, the plate 103 is secured to a yoke YO attached to a magnet 109, and the plate 102 is threadedly secured to the plate 103 by means of a screw S, while adjusting the rotary shaft 108 and the rotor 105 to be at right angles.

Because of the high degree of accuracy required during assembling, such a pump is disadvantageous in that the pump plate 102 and the casing CA, or the pump plate 103 and the yoke YO are difficult to construct integrally and the number of parts is increased, whereby the pump itself tends to be larger.

As the sucked fuel is pumped out toward the left as viewed in FIG. 3 under high pressure, such as, about 3 kg/cm$^2$, the pump must be designed in such a manner that the highly pressurized fuel does not leak out of the pump. For this reason, the casing CA of the pump 101 is so designed as to include a pump housing, a yoke YO, an union UN and a member RE on the discharge side. Further, an oil seal OS is provided around the member RE for preventing leakage of liquid, and the left end of the casing CA is staked, as at k. Accordingly, in this pump structure, the axial length of the pump becomes long and the number of associated parts is increased, thereby leading to increased manufacturing costs.

In a traditional high pressure pump (1.5kg/cm$^2$ and more), a displacement pump such as a vane pump is employed for a fuel pump of an automobile. Such a pump has a disadvantage that a pulsing motion is created during the pumping operation, thereby causing fuel lines to vibrate and associated noises to be generated. This is especially true a vane pump which disadvantageously creates such noises during operation.

It has been attempted in the prior art to develop a pump, other than such a displacement pump, which is compact and capable of generating a high pressure efficiently. In a regenerative pump substituted for such a displacement pump, and particularly in a regenerative pump having one stage of impeller as seen in FIG. 5, illustrating the corelation of discharge amount and discharge pressure, the flow rate under lower pressure is high, but as the pressure increases, the flow rate greatly decreases, making it diffuicult to ensure proper flow rate under a higher pressure (1.5 kg/cm$^2$ and more). For this reason, this construction is not applicable to a high pressure fuel pump for an automobile. In another type of regenerative pump having two stages of impeller the flow rate increases under higher pressure and a high cut-off pressure can be obtained. However, generally in the structure of such a regenerative pump, since the clearnaces between both side surface of the impeller and the casing have to be set to an extremely small width, say, about 10–20μm, and the machining accuracy of pump elements must be designed to several μm of tolerance, even in the case of the regenerative pump having one stage of impeller as well as the assembling, accuracy of each part has to be extremely critical. Furthermore, the right angle of the armature rotary shaft against the impeller coaxially fitted to the rotary shaft is critically ensured in association with the clearances of about 10–20μm between both side surfaces of the impeller and the casing. This casuses reduced productivity of such pumps. Particularly in a regenerative pump having two stages of impeller, because of the abovementioned requirements, the productivity of such pumps is further decreased to the extent that such pumps are not applicable for a high pressure use such as in a fuel pump of an automobile.

SUMMARY OF THE INVENTION

Accordingly, it is an object of the present invention to provide an electrically powered pump which can be operated without decreasing its pumping efficiency and durability irrespective of the problems of eccentricity created in the armature rotary shaft of a motor and the axis of a rotor, or reduced squareness of the pump plate against the rotary shaft.

It is another object of the present invention to provide an electrically powered pump which may be constructed simply and compactly.

It is still another object of the present invention to provide an electrically powered pump which can generate high pressures and large flow rates of pumped liquid with an extremely lower degree of vibration and noise than a displacement pump and without descreasing the pumping efficiency and durability irrespective of the problems of eccentricity created between the armature rotary shaft of a motor and the axis of a rotor, or reduced squareness of the pump plate against the rotary shaft.

Various general and specific objects, advantages and aspects of the invention will become apparent when reference is made to the following detailed description considered in conjunction with the accompanying drawings.

DETAILED DESCRIPTION OF THE PREFERRED EMBODIMENTS

Figure 1:
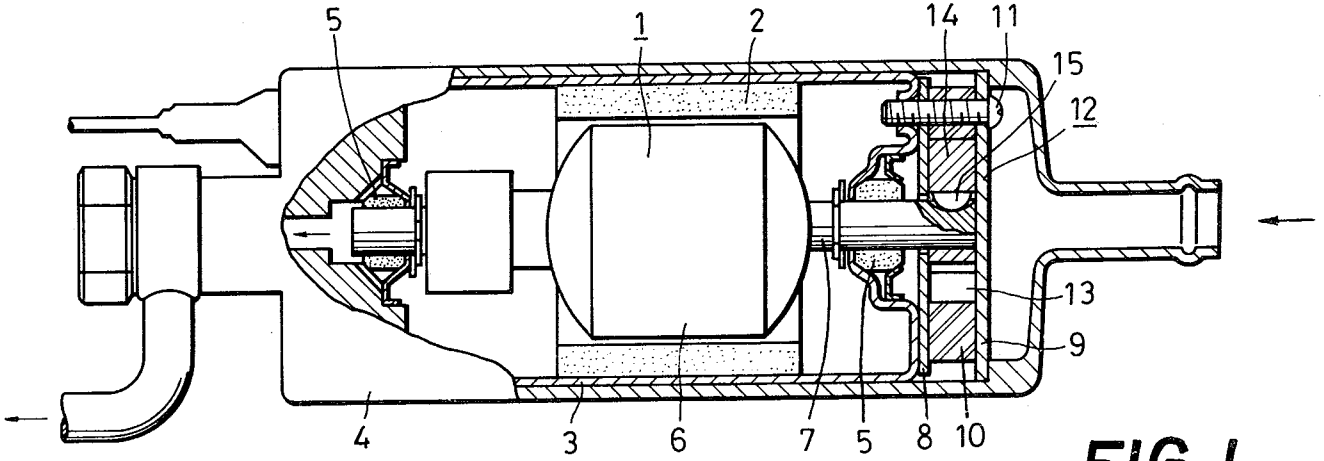
FIG. 1 is a vertical section of an electrically powered pump according to the prior art.
Figure 2:
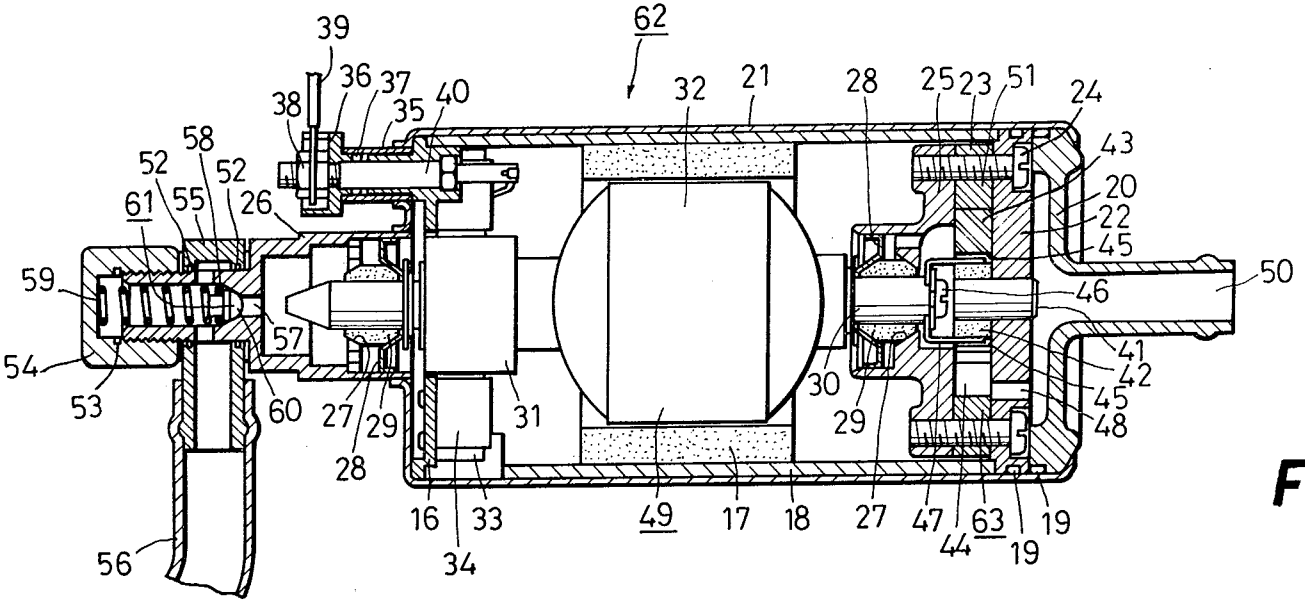
FIG. 2 Prior Art
FIG. 2 is a vertical section of the electrically powered pump according to the first embodiment of the invention.

Referring now to FIG. 2, a cylindrical housing 21 is provided with a ring-like base plate 16 made of synthetic resin, a yoke 18 attached to a permanent magnet 17 as a field core, an O-ring 19 and a cover plate 20 on the suction side. A pump base 22 is mounted at one end of the cylindrical housing 21. A pump plate 25 is secured through a spacer 23 to the pump base 22 by means of screws 24. A plug-like cover plate 26 on the discharge side is mounted at the other end of the housing 21. Hemispherical bearing-receiving surfaces 27 and bearing hold-down members 28 are provided on the pump plate 25 and the plug-like cover plate 26. Spherical plain bearings 29 made of sintered alloy are supported by the bearing-receiving surfaces 27 and the bearing hold-down members 28. A rotary shaft 30 of an armature 32 is rotatably supported by the plain bearings 29 between the pump plate 25 and the plug-like cover plate 26. A brush 33 is mounted to the ring-like base plate 16 by means of a brush holder 34 and a spring (not shown) and serves to supply electrical current to the armature 32 on the rotary shaft 30 by press-fittedly contacting with a commutator 31 on the rotary shaft 30. An insulating plug 36 made of synthetic resin is inserted into a bushing 35 on the housing 21. A terminal 40 connected to an outer conductor 39 is provided between the insulating plug 36 and the base plate 16 through an O-ring 37 and a nut 38. The commutator 31 is connected through the terminal 40 to the outer conductor 39.

A fixed shaft 41 is positioned in alignment with the rotary shaft 30 and its one end projects into a pump casing defined by a spacer 23. A rotor 43 is arranged around the projected portion of the fixed shaft 41 in the pump casing through a plain bearing 42. A roller 44 is arranged at the outer circumference of the rotor 43 in equally spaced apart relation therewith and contacts to the inner circumference of the pump casing, the axis of which is eccentric to the axis of the rotor 43, with the displacement in the radial direction. Elongated through-holes 45 are formed near the central portion of the rotor 43 in circumferentially equally spaced apart relation therewith. A connector 47 is fixed to one end of the rotary shaft 30 with no movement relative thereto by means of a screw 46 and a notch (not shown). The connector 47 is engaged with the through-holes 45 so that the rotary shaft 30 and the rotor 43 may not relatively move in the circumferential direction.

A suction aperture 48 is formed through the pump base 22, and a discharge aperture (not shown) is formed through the pump plate 25. When the rotor 43 is rotated by the motor 49, the liquid from a suction line 50 integrally formed with the cover plate 20 is delivered from the suction aperture 48 in the pump means 51 to the discharge aperture. A line coupling member 55 is rotatably fitted to the cover plate 26 through O-rings 52 and 53 and a cap nut 54. The liquid delivered into the motor is then expelled through the line coupling member 55 and a deilvery line 56. A check valve 61 provided in a discharge passage 57 formed in the cover plate 26 in such a manner that the spherical surface of a valve body 60 is abutted against the tapered surface 58 by a spring 59.

Figure 4:
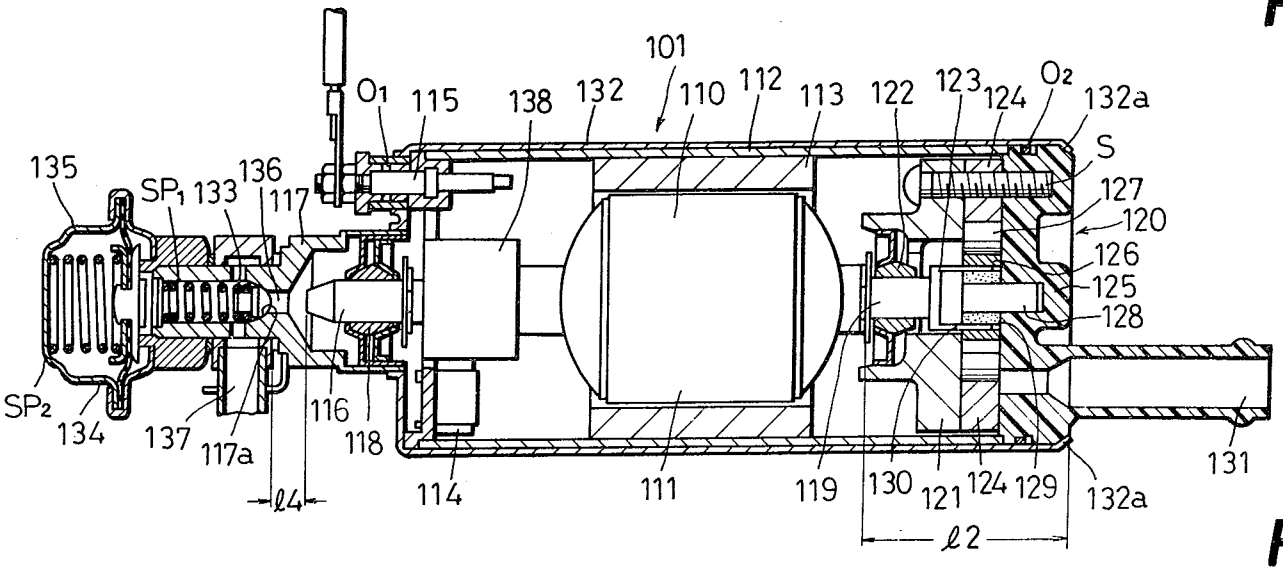
FIG 4 Prior Art
FIG. 4 is a vertical section of the electrically powered pump according to the second embodiment of the invention.
Figure 5:
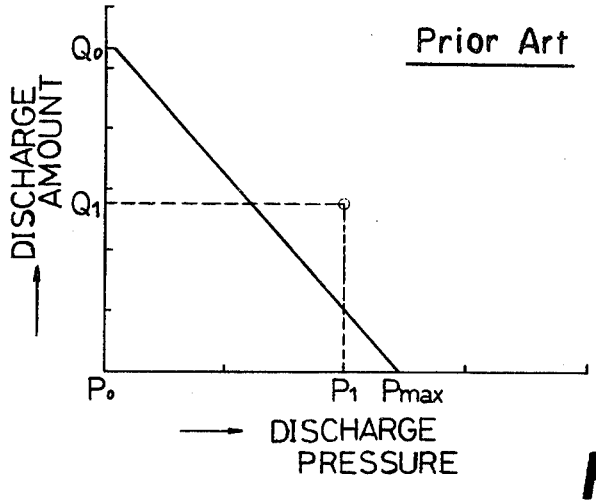
FIG. 5 is a characteristic diagram of another prior art embodiment.
Figure 6:
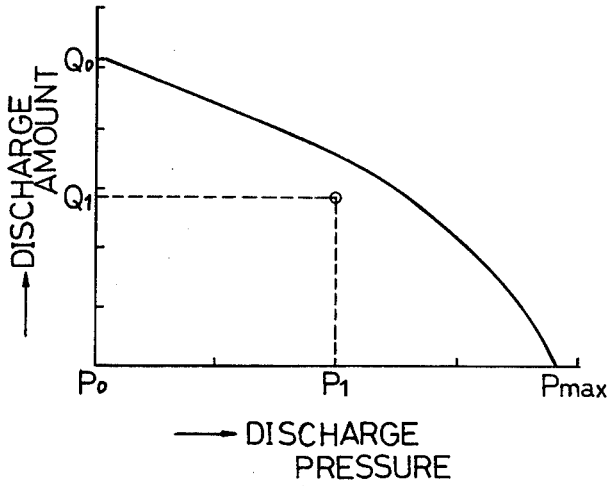
FIG. 6 is a characteristic diagram commonly developed in the prior art as well as in the third embodiment of the invention.

Referring next to FIG. 4 which illustrates the second embodiment of the present invention, a motor 110 consists of a magnet 113 fitted to an armature 111 and a yoke 112, a brush 114 and an electrical terminal 115 fixed to a resin base plate. The yoke 112 is preferably received in a casing 132.

A rotary shaft 116 disposed in the left hand side of an armature 111 as viewed in the drawing is rotatably supported by a bearing 118 fixed to a plug-like union 117, while a rotary shaft 119 disposed in the right hand side of the armature 111 is rotatably supported by a bearing 122 fixed to a pump plate 121 which is a part of a housing of a pump means 120. A connector 123 which has a forked or two-way projection is fixed to one end of the rotary shaft 119.

The pump means 120 consists of a pump chamber which includes the pump plate 121, a spacer 124 and a suction cover plate 125, and a rotary section which mainly includes a rotor 126, a roller 127 and a fixed shaft 128.

The fixed shaft 128 is fixed into the suction cover plate 125 such that it is coaxial with the rotary shaft 128 through a plain bearing 129. Elongated through-holes 130 are formed near the central portion of the rotor 126 in circumferentially equally spaced apart relation therewith so as to engage with the connector 123.

A suction line 131 is integrally formed with the suction cover plate 125 which is a part of the casing of the pump 101 and a side wall of the pump chamber of the pump means 120. The suction cover plate 125 is attached to the right end of the yoke 112 as viewed in the drawing and fixed to the edge 132a of the casing 132 by staking.

The spacer 124 and the pump plate 121 are fixed to the suction cover plate 125 by four screws S (only one screw being depicted in the drawing).

The union 117 is preferably brazed to the casing 132 and provided with a bearing 118, a check valve 133 and a silencer 135. The check valve 133 is biased against the tapered surface 117a of the union 117 by a spring SPl and serves to open a discharge aperture 136 when fuel pressure applied to the discharge aperture 136 exceeds the predtermined value. The silencer 135 serves to prevent the pulsing motion of the fuel delivered through the discharge aperture 136 by means of a diaphragm 134 and a spring SP2.

An O-ring $O_1$ is received between the electrical terminal 115 and the casing 132 and another O-ring $O_2$ is received between the casing 132 and the suction cover plate 125.

Figure 7:
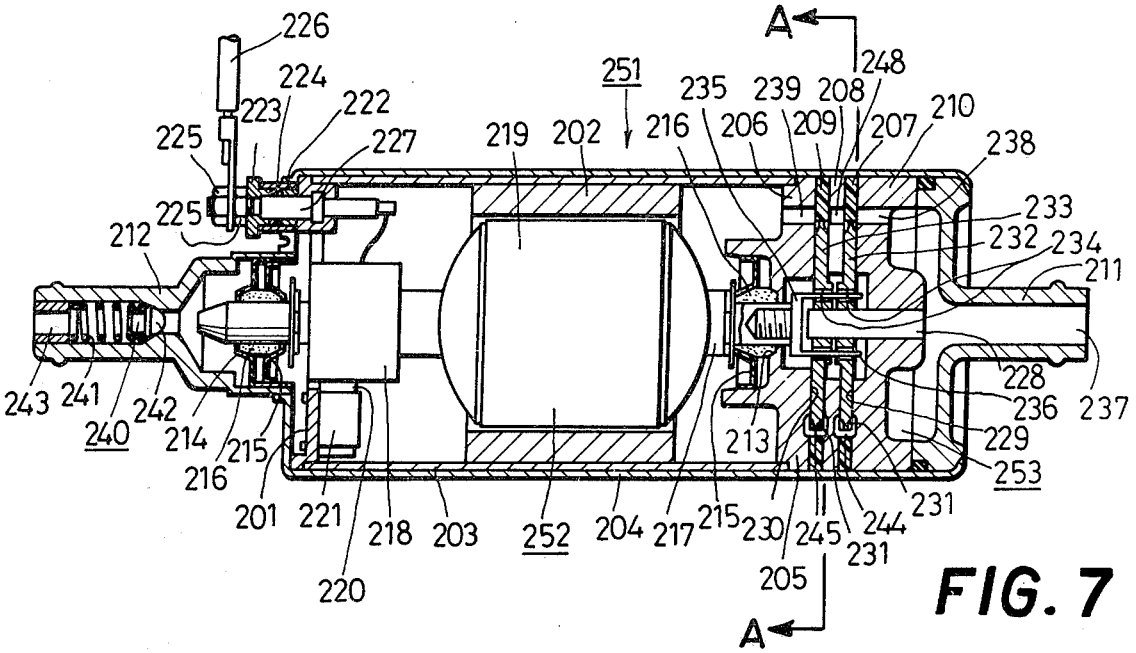
FIG. 7 is a vertical section of the electrically powered pump according to the third embodiment of the invention.
Figure 8:
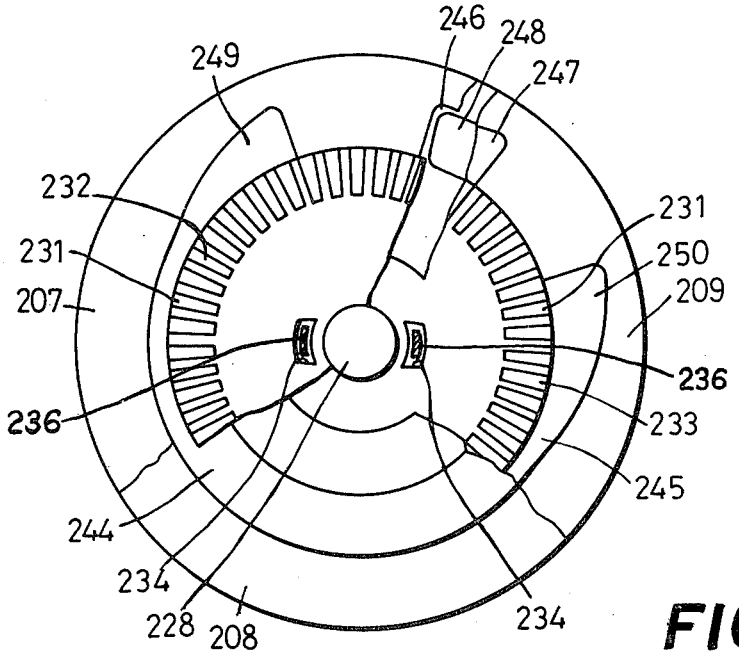
FIG. 8 is a detailed illustrative sectional view of the essential parts taken along line 8—8 of FIG. 7.

Referring to FIGS. 7 and 8 which illustrate the third embodiment of the present invention, a cylindrical housing 204 is provided with a ring-like base plate 201 made of synthetic resin and a yoke 203 attached to a permanent magnet 202 as a field core. An end plate 206 on the discharge side, a first sealing spacer 207, an interposed plate 208, a second sealing spacer 209, an end plate 210 on the suction side and a cover plate 211 on the suction side are assembled to form a pump casing 205 at one end portion (at the right portion as viewed in FIG. 7) of the housing 204 by the staking at the circumferential edge of the housing 204. A plug-like cover plate 212 is provided at the other end portion (at the left portion as viewed in FIG. 7) of the housing 204. A spherical plain bearing 216 made of sintered alloy is supported by a hemispherical bearing-receiving surface 213 integrally formed with the end plate 206, a bearing-receiving member 214 made of spring steel plate and a bearing holding-down member 215. A rotary shaft 217 of the armature 219 is rotatably supported by the plain bearing 216 between the cover plate 212 and the end plate 206 of the pump casing 205. A brush 220 is mounted to the phase 201 by means of a brush holder 221 and a spring (not shown) and serves to supply electrical current to the armature 219 on the rotary shaft 217 by press-fittedly contacting with a commutator 218 on the rotary shaft 217. An insulating plug 223 made of synthetic resin is inserted into a bushing 222 on the housing 204. A terminal 227 connected to an outer conductor 226 is provided between the insulating plug 223 and the base plate 201 through an O-ring 224 and a nut 225. The commutator 218 is connected through the terminal 227 to the outer conductor 226.

A fixed shaft 228 is fixedly inserted into the end plate 210 and positioned in alignement with the rotary shaft 217 and its one end portion projects into pump chambers 229 and 230 defined by the first spacer 207 and the second spacer 209, respectively. A first impeller 232 and a second impeller 233 having a plurality of grooves 231 along their outer circumferences are arranged around the projected portion of the fixed shaft 228 in the pump chambers 229 and 230, respectively in such a manner that both impellers can independently rotate. Elongated through-holes 234 are formed near the central portion of the impellers 232 and 233 in circumferentially equally spaced apart relation therewith. A connector 235 is fixed to one end of the rotary shaft 217 by a serration. A forked or two-way projection 236 of the connector 235 is engaged with the through-holes 234 so that the rotary shaft 217 and the impellers 232 and 233 may not relatively move in the circumferential direction.

A fuel suction line 237 is integrally formed with the cover plate 211. A suction aperture 238 is formed through the end plate 210 on the suction side. A discharge aperture 239 is formed through the end plate 206 on the discharge side. A fuel delivery line 243 receiving a spring 241 and a valve body 242 of a check valve 240 is integrally formed with the plug-like cover plate 212. Liquid passages 244 and 245 are formed in the pump chamber 229 of the first impeller 232 and the pump chamber 230 of the second impeller 233 along the outer circumferences of the impellers 232 and 233, respectively. A discharge aperture 246 of the liquid passage 244 and a suction aperture 247 of the liquid passage 245 are communicated with a communication path 248 formed through the interposed plate 208. A suction aperture 249 of the liquid passage 244 is registered with the suction aperture 238 of the end plate 210 on the suction side. A discharge aperture 250 of the liquid passage 245 is registered with the discharge aperture 239 of the end plate 206 on the discharge side.

In operation of the electrically powered pump 62 as shown in FIG. 2, when the motor 49 is driven, the rotor 43 is rotated through the connector 47. During the rotation of the rotor 43, even if the axis of the rotary shaft is axially offset from the axis of the fixed shaft 41, the offset of the axes of both shafts is absorbed by the connector 47 because of the slightly loose engagement between the through-holes 45 formed through the rotor 43 and the connector 47. Even if the rotary shaft 30 is not completely perpendicular to the end surface of the rotor 43, and the clearance between the pump base 22 and the pump plate 25 is selected to about 10μm necessary to obtain a high pumping efficiency, the rotary shaft 30 is not subjected to excessive torque because the tolerance of the angle is absorbed by virtue of the slightly loose engagement of the connector 47 with the through-holes 45, thereby causing the electrically powered pump 62 to be smoothly operated. In the event that the motor 49 and the pump 63 are independently manufactured with a high degree of accuracy corresponding to the individual performances of the motor and the pump, they are readily assembled to form an electrically powered pump ensuring the stable performances of the motor and the pump.

In a modification of this embodiment, the connector 47 may be fixed to the rotor 43, or to both the rotary shaft 30 and the rotor 43. The shape and the material of the connector 47 may be suitably set depending upon the structure of the electrically powered pump 62 and the characteristics of the pump 63.

Next, in operation of the electrically powered pump 101 as showin in FIG. 4, when electrical power is supplied from the outer conductor to the electrical terminal 115, the current flows into the commutator 138 through the brush 114 and the armature 111 begins to rotate. This causes the rotor 126 in the pump means 120 to rotate together with the rollers 127 which are rotatably mounted along the outer circumference of the rotor 126 in circumferentially equally spaced apart relation therewith and contacts with the inner circumference with the displacement in the radial direction. Because of this rotary motion of the rotor 126, a negative pressure is created, thereby causing fuel to be sucked through the suction aperture 131 and delivered through the casing 132, the discharge aperture 136 and the delivery line 137.

During this operation, even if the axis of the rotary shaft 119 of the armature 111 is slightly offset from the axis of the fixed shaft 128, the offset of the axes of both the shafts is absorbed by the connector 123 because of the slightly loose engagement between the connector 123 and the through-holes 130 formed through the rotor 126. Accordingly, even if any parts of the electrically powered pump are manufactured with a high degree of accuracy according to the individual performance of the parts, they are readily assembled to form an electrically powered pump, ensuring stable performance of each part, increased reliability, improved productivity and reduced cost.

Figure 3:
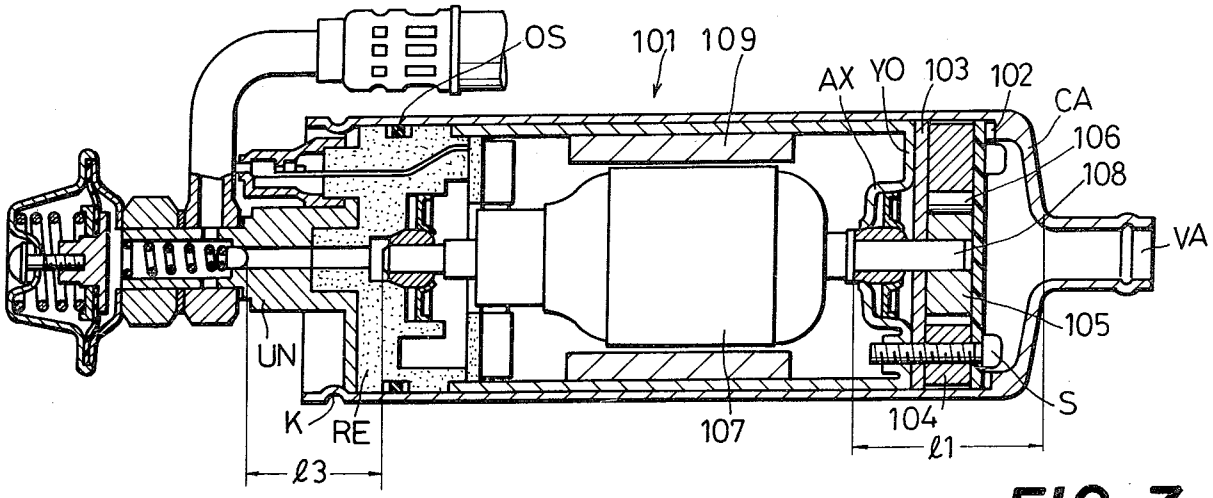
FIG. 3 is a vertical section of another electrically powered pump according to the prior art.

As hereinbefore described, the tolerance created in the connection of the rotor 126 and the rotary shaft 119 is absorbed by the connector 123, so that the pump plate 102 and the casing CA, which were separately mounted in the prior art as shown in FIG. 3, can be integrally formed with the cover plate 125 on the suction side. Furthermore, the pump plate 103 and the rotary shaft 108, which were separately mounted so as to modify the accuracy after assembling in the prior art, can be integrally formed with the pump plate 121 because there is no necessity of highly accurate assembling of the parts. As a result, regardless of an increased thickness of the pump plate 121 and the cover plate 125 so as to enhance the strength of the casing 132, they may be arranged within the space $l_2$ substantially equal to the space $l_1$ as shown in FIGS. 3 and 4. In the case that the strength of the casing 132 is similar to that in the prior art, the pump means 120 may be constructed compactly.

In this embodiment, the bearing 118 is received in the union 117 which is preferably brazed to the casing 132, thereby eliminating the need for the resin member RE and the oil seal OS (See FIG. 3) which were necessary to bear against a high fuel pressure and prevent the leakage of fuel. Accordingly, the number of parts constituting the pump 101 may be reduced and the axial length of the discharge portion of the pump 101 may be shortened by the distance $l_3$–$l_4$.

In a modification of this embodiment, the pump means 120 may be employed as an axial-flow pump, a centrifugal pump and so on, as desired. The motor 110 may be employed as an induction motor, a step motor or the like, as desired.

In operation of the electrically powered pump 251 as shown in FIG. 7, when the motor 252 is driven, the first impeller 232 and the second impeller 233 are rotated through the connector 235. During the rotation of both the impellers 232 and 233, even if the axis of the rotary shaft 217 is axially offset from the axis of the fixed shaft 228, the offset of the axes of both shafts is absorbed by the connector 235 and the through-holes 234 because of the slightly loose engagement between the through-holes 234 formed through the impellers 232 and 233 and the projected portion 236 of the connector 235. Even if the rotary shaft 217 is not completely perpendicular to the end surface of the impellers 232 and 233 and the clearance between the end surfaces of both the impellers 232 and 233 and the pump casing 205 is set to about 10–20μm necessary to obtain a high pumping performance, the rotary shaft 217 is not subjected to excessive torque because the tolerance of the angle is absorbed due to the slightly loose engagement of the connector 235 with the through-holes 234, thereby ensuring the smooth operation of the electrically powered pump 251. In the event that the motor 252 and the pump 253 are independently manufactured with a high degree of accuracy corresponding to the individual performances of the motor and the pump, they are readily assembled to form an electrically powered pump ensuring the stable performance of the motor and the pump.

In this embodiment employing two stages of impellers 232 and 233, the fuel sucked into the pump chamber 229 through the suction aperture 238 by the rotation of the first impeller 232 is pressurized in the liquid passage 244 and pumped through the discharge aperture 246, the communication path 248, the suction aperture 247 into the pump chamber 230. Thereafter, the fuel is further pressurized in the liquid passage 245 of the pump chamber 230 and pumped to the discharge aperture 250 to be delivered through the fuel delivery line 243. Then, the fuel is smoothly supplied to an electromagnetic fuel injector valve, for example, with high pressure and large flow rate as well as with low noise and substantially no vibrations.

In the prior art employing one stage of impeller, the required flow rate at a high pressure is ensured by enlarging the outer diameter of the impeller or increasing the number of revolutions of the impeller, however, the former causes the outside structure to become large and the latter requires that the pump parts be very accurately manufactured, resulting in the reduced durability of the parts. On the contrary, according to this embodiment, the rotary shaft and the impellers are connected through the connector. This enables the number of the stage of the impeller to be increased and the required flow rate at a high pressure to be ensured without substantially enlarging the outside structure of the pump and increasing the number of revolutions of the impeller and with the reduced production cost of the pump.

In the case that three and more stages of impellers are employed in the pump, it is possible that an additional spacer, interposed plate and impeller may be provided as described so as to readily increase the number of stages of the impeller. The adjacent end plates 206 and 210 are integrally formed with the first spacer 207 and the second spacer 209 or the first spacer 207 and the second spacer 209 are also integrally formed with the interposed plate 208, depending upon the pumping efficiency and the productivity of the pump. Any other types of pumps such as a centrifugal pump and an axial-flow pump may be employed in this embodiment.

The rotary shaft 217 may be connected to either impeller 232 or 233, both of which are connected each other, or the rotary shaft 217 may be individually connected to the impellers 232 and 233. The connector 235 may be fixed to the impellers 232 and 233, or to both the rotary shaft 217 and the impellers 232 and 233. The shaped and material of the connector 235 may be suitably set depending upon the structure and characterisitics of the electrically powered pump 251. For example, the number of the projections of the connector 235 may be increased as desired.

Although some preferred embodiments of the invention have been disclosed and described, it is apparent that other embodiments and modifications of the invention are possible within the scope of the appended claims.

What is claimed is:

1. An electrically powered pump comprising:

a cylindrical housing 204 provided with a field core 202 therein;

a motor 252 mounted in said housing;

a plug-like cover plate 212 attached to one end of said housing and formed with a fuel delivery line 243 passing therethrough;

a pump casing 205 provided at the other end of said housing, said pump casing comprising an end plate 206 on the discharge side, a second sealing spacer 209, an intermediate plate 208, a first sealing spacer 207, an end plate 210 on the suction side and a cover plate 211 on the suction side formed with a fuel suction line 237 passing therethrough;

a first and a second pump chamber 229 and 230 defined on both sides of said intermediate plate;

a first and a second impeller 232 and 233 rotatably mounted in said first and second pump chambers, respectively, said impellers being individually rotatably supported by a fixed shaft 228 fixed to said end plate;

an armature 219 supported by said bearings and mounted in said housing; and a connector 235 fixed to the shaft end of said armature on said pump chambers side, said connector being adapted to connect said armature with said impellers in such a manner that the relative motion in a circumferential direction of said connector and said impellers is restricted and that the eccentricity of said armature and said impellers may be absorbed by said connector.

2. The electrically powered pump as defined in claim 1 wherein said connector is provided with axially extending projections 236 at the circumferentially equally spaced apart position and said impellers are provided with circumferentially elongated holes 234 formed at the position corresponding to said projections, whereby said projections of said connector are engaged with said holes of said impellers.

* * * * *